US006119449A

United States Patent [19]

Köhler

[11] Patent Number: 6,119,449

[45] Date of Patent: Sep. 19, 2000

[54] INTERNAL COMBUSTION ENGINE AND METHOD OF OPERATING THE SAME

[75] Inventor: Christian Köhler, Erligheim, Germany

[73] Assignee: Robert Bosch GmbH, Stuttgart, Germany

[21] Appl. No.: 09/150,600

[22] Filed: Sep. 10, 1998

[30] Foreign Application Priority Data

Sep. 11, 1997 [DE] Germany ..... 197 39 848

[51] Int. Cl.[7] ..... F01N 3/00

[52] U.S. Cl. ..... 60/274; 60/276; 60/285; 701/102; 701/103

[58] Field of Search ..... 60/274, 285, 297, 60/276, 295, 286; 701/102, 103, 115

[56] References Cited

U.S. PATENT DOCUMENTS

| | | | |
|---|---|---|---|
| 5,433,074 | 7/1995 | Seto et al. | 60/601 |
| 5,437,153 | 8/1995 | Takeshima et al. | 60/276 |
| 5,471,836 | 12/1995 | Takeshima et al. | 60/297 |
| 5,740,669 | 4/1998 | Kinugasa et al. | 60/285 |
| 5,743,084 | 4/1998 | Hepburn | 60/274 |
| 5,791,139 | 8/1998 | Atago et al. . | |
| 5,894,725 | 4/1999 | Cullen et al. | 60/274 |

FOREIGN PATENT DOCUMENTS

| | | |
|---|---|---|
| 0 598 916 | 12/1993 | European Pat. Off. . |
| 0 764 771 | 3/1997 | European Pat. Off. . |
| 195 06 980 | 9/1996 | Germany . |
| 07 189660 | 7/1995 | Japan . |
| 2 307 311 | 5/1997 | United Kingdom . |
| WO 97/17532 | 5/1997 | WIPO . |
| WO 97/28461 | 8/1997 | WIPO . |

*Primary Examiner*—Thomas Denion
*Assistant Examiner*—Binh Tran
*Attorney, Agent, or Firm*—Walter Ottesen

[57] ABSTRACT

The invention is directed to an internal combustion engine such as an engine for a motor vehicle. The engine defines a combustion chamber wherein an air/fuel mixture is combusted during operation of the engine whereby an exhaust gas containing nitrogen oxides is generated. The engine has a catalytic converter for treating the exhaust gases including reducing the nitrogen oxides. The air/fuel mixture supplied to the combustion chamber is adjusted in such a manner that first an oxygen excess is present in the combustion chamber and then an oxygen deficiency is present. A control apparatus determines the mass (mNOx) of the nitrogen oxides flowing to the catalytic converter during oxygen excess and changes over from the oxygen excess to the oxygen deficiency when the mass (mNOx) reaches a pregiven inflow mass (mZ).

11 Claims, 4 Drawing Sheets

INTERNAL COMBUSTION ENGINE AND METHOD OF OPERATING THE SAME

FIELD OF THE INVENTION

The invention relates to an internal combustion engine and a method for operating the engine such as an engine of a motor vehicle. In the method, an air/fuel mixture is combusted in a combustion chamber wherein the exhaust gas generated by the combustion is treated by a catalytic converter. The catalytic converter is suitable for the reduction of nitrogen oxides which enter the converter and, in the method, the air/fuel mixture is so supplied to the combustion chamber such that first an oxygen excess and then an oxygen deficiency is present in the combustion chamber.

Furthermore, the invention also relates to an internal combustion engine such as for a motor vehicle. The engine has means for combusting an air/fuel mixture in a combustion chamber and has a catalytic converter for treating the exhaust gases generated during the combustion. The catalytic converter is suitable for reducing the nitrogen oxides entering the converter. The air/fuel mixture is supplied to the combustion chamber so that an oxygen excess is first present in the combustion chamber and then an oxygen deficiency is present.

BACKGROUND OF THE INVENTION

A method and an internal combustion engine of this kind are disclosed in German Patent 195 06 980. There, the air/fuel mixture, which is supplied to the combustion chamber, is controlled in such a manner that alternately a rich air/fuel mixture (oxygen deficiency) and a lean air/fuel (oxygen excess) is present. The time intervals of the oxygen deficiency or of the oxygen excess are fixed in advance. The exhaust gasses generated during combustion are supplied to a catalytic converter which is provided, inter alia, for reducing the nitrogen oxides.

On the one hand, a catalytic converter of this kind operates as an oxidation catalytic converter. This means that, when there is a deficiency of oxygen, the oxygen is withdrawn from the nitrogen oxides and the hydrocarbons generated by the combustion and the carbon monoxides likewise so generated are all oxidized with this oxygen. For an oxygen excess, the oxidation catalytic converter could likewise reduce the nitrogen oxides. However, this reaction does not take place because of the oxygen present in excess and the oxidation catalytic converter uses the excess oxygen in lieu thereof.

On the other hand, the above-mentioned catalytic converter operates as a storage catalytic converter. This means that the nitrogen oxides, which are generated during combustion, are taken up by the storage catalytic converter when there is an oxygen excess. The storage catalytic converter releases the nitrogen oxides taken up when there is an oxygen deficiency.

By using the oxidation catalytic converter and the storage catalytic converter in the above-mentioned catalytic converter, the condition is achieved that the nitrogen oxides, which cannot be used by the oxidation catalytic converter when there is an oxygen excess, are taken up by the storage catalytic converter and are intermediately stored. When there is an oxygen deficiency, the nitrogen oxides, which are released by the storage catalytic converter, are reduced by the oxidation catalytic converter.

The storage catalytic converter can, however, only take up a limited mass of nitrogen oxides. This has the consequence that the storage catalytic converter must again be discharged after a certain loading time in which it takes up the nitrogen oxides. During the discharging, the storage catalytic converter again releases the nitrogen oxides so that it can be charged anew thereafter. If the storage catalytic converter is discharged too late, this has the consequence that the nitrogen oxides no longer can be taken up by this converter because of the "filled" converter and, therefore, escape as toxic substances into the environment. If the storage catalytic converter is discharged too long, it is then "empty" and no longer supplies nitrogen oxides so that the oxygen catalytic converter does not have the oxygen for oxidizing the hydrocarbons and the carbon monoxides whereby they escape to the environment as toxic substances.

The charging and discharging of the storage catalytic converter must therefore be controlled (open-loop control and/or closed-loop control). This is achieved by means of the oxygen inflow. During oxygen excess, the storage catalytic converter is charged and takes up the nitrogen oxides and, during an oxygen deficiency, the storage catalytic converter is discharged and releases nitrogen oxides. In the above-mentioned German Patent 195 06 980, the oxygen excess and the oxygen deficiency are controlled over initially fixed time intervals. However, this has been shown to be too imprecise.

SUMMARY OF THE INVENTION

It is an object of the invention to provide a method and an internal combustion engine of the kind referred to above wherein the charging and discharging of the storage catalytic converter is precisely influenced.

The method of the invention is for operating an internal combustion engine such as an engine for a motor vehicle. The internal combustion engine defines a combustion chamber wherein an air/fuel mixture is combusted during operation of the engine whereby an exhaust gas containing nitrogen oxides is generated. The method includes the steps of: treating the exhaust gas with a catalytic converter suitable for reducing the nitrogen oxides supplied thereto; supplying the air/fuel mixture to the combustion chamber in such a manner that an oxygen excess is first present in the combustion chamber and then an oxygen deficiency is present therein; determining the mass (mNOx) of the nitrogen oxides flowing into the catalytic converter during the oxygen excess; and, changing over from the oxygen excess to the oxygen deficiency when a pregiven inflow mass (mZ) is reached.

The internal combustion engine of the invention is, for example, an engine for a motor vehicle. The internal combustion engine defines a combustion chamber wherein an air/fuel mixture is combusted during operation of the engine an exhaust gas containing nitrogen oxides is generated and the internal combustion engine includes: a catalytic converter for treating the exhaust gases including reducing the nitrogen oxides when supplied thereto; means for adjusting the air/fuel mixture supplied to the combustion chamber in such a manner that first an oxygen excess is present in the combustion chamber and then an oxygen deficiency is present therein; and, a control apparatus for determining the mass (mNOx) of the nitrogen oxides flowing to the catalytic converter during the oxygen excess and for changing over from the oxygen excess to the oxygen deficiency when the mass (mNOx) reaches a pregiven inflow mass (mZ).

Thus, the mass of nitrogen oxides actually flowing to the catalytic converter is determined and applied for influencing the supply of oxygen. This defines a significantly more precise charging operation than with the known input of a time interval. When the inflow mass is reached, this means that, thereafter, the storage catalytic converter would overflow. This is prevented by a changeover toward oxygen deficiency.

An overflow of the catalytic converter is reliably avoided by the determination of the nitrogen oxides actually flowing to the catalytic converter. The situation is prevented that the engine continues to be operated with an oxygen excess even though the storage catalytic converter can no longer take up any nitrogen oxides. In this way, the nitrogen oxides are either taken up by the storage catalytic converter or are reduced by the oxidation catalytic converter. Toxic nitrogen oxides can therefore not escape to the environment.

In an advantageous embodiment of the invention, the mass of the nitrogen oxides, which flow to the catalytic converter, is determined by integrating the mass flow of the nitrogen oxides flowing to the catalytic converter. This defines a simple and nonetheless reliable way to determine the mass of the nitrogen oxides which reach the catalytic converter.

It is especially purposeful when the mass flow of the nitrogen oxides, which flows toward the catalytic converter, is determined from the air mass flow to the combustion chamber or from the load applied to the engine. Both possibilities ensure a rapid and precise determination of the mass flow of the nitrogen oxides. The relationship between the mass flow of the nitrogen oxides and the air mass flow or the load can be stored in a characteristic field which is dependent especially upon the rpm of the engine.

Furthermore, it is advantageous when, for the determination, the rpm of the engine and/or the ratio of the air/fuel mixture in the combustion chamber is considered and/or when a factor is considered which corresponds to the component of the nitrogen oxides which are released to the environment.

In an advantageous embodiment of the invention, the mass of the nitrogen oxides, which are still present in the catalytic converter, are determined during the oxygen deficiency and, when a pregiven outflow mass is reached, the oxygen deficiency is ended. This defines the changeover of the charging process of the storage catalytic converter, that is, the discharge of the catalytic converter. The control apparatus determines the mass of nitrogen oxides, which actually flows off from the catalytic converter, and applies this mass for influencing the supply of oxygen. This defines a significantly more precise discharge operation than for the known input of a time interval. Only when so many nitrogen oxides have flown out of the catalytic converter that the storage catalytic converter is emptied, then the oxygen deficiency, and therefore the discharge, is ended. In this way, a complete emptying of the storage catalytic converter is achieved via the determination by the control apparatus of the nitrogen oxides actually flowing out of the catalytic converter and therefore, an optimal utilization of the storage function of the catalytic converter is achieved.

According to another feature of the invention, the mass of the nitrogen oxides, which flow from the catalytic converter, are determined by integrating the mass flow of the nitrogen oxides flowing out of the catalytic converter. Here, it is advantageous when a factor is considered in making the determination which corresponds to the component of the carbon monoxides released to the environment.

In another advantageous embodiment of the invention, the pregiven inflow mass and/or the pregiven outflow mass are determined in dependence upon the temperature of the catalytic converter and/or on the saturation characteristic of the catalytic converter. In this way, a high precision for the input of the inflow and outflow masses is achieved. Furthermore, the nonlinear characteristic of the catalytic converter is considered during the charging and discharging operation via the saturation characteristic of the catalytic converter.

In an advantageous configuration of the invention, the oxygen deficiency is ended after a pregiven time duration. Accordingly, the discharge operation is carried out in dependence upon time by the control apparatus. This is possible because the discharge operation usually takes only one to two seconds. Because of the shortness of this time duration, only a small error can occur via the time-dependent control of the discharge, if at all, in comparison to the mass-dependent control. For this reason, the time-dependent termination of the discharge operation in combination with the mass-dependent charging of the catalytic converter defines a rapid and effective way to control the supply of oxygen and therefore the charging and discharging of the catalytic converter via the control apparatus.

It is especially purposeful when the time duration is determined in dependence upon the following: the rpm of the engine and/or the load applied to the engine and/or the temperature of the catalytic converter and/or the temperature of the engine. With these parameters, it is possible to initially determine relatively precisely the time duration for the discharge.

In an advantageous further embodiment of the invention, the ratio of the air/fuel mixture is monitored downstream of the catalytic converter and the termination of the oxygen deficiency is influenced in dependence thereon. As soon as a transition from a lean to a rich air/fuel mixture is detected, this means that the storage catalytic converter no longer releases sufficient oxygen for the oxidation of the hydrocarbons and the carbon monoxide. The storage catalytic converter is thus discharged. Thereafter, the oxygen deficiency and therefore the discharge operation can be terminated and the oxygen supply is again reversed to a charging operation.

Of special significance is the realization of the method of the invention in the form of a control element which is provided for a control apparatus of an engine such as the control apparatus of a motor vehicle. A program is stored on the control element which is configured especially as a storage medium. The program can be run on a computation apparatus such as a microprocessor and is suitable for executing the method of the invention. In this case, the invention is realized by a program, which is stored in the control element, so that this storage medium provided with the program defines the invention in the same manner as the method which can be executed by the program.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
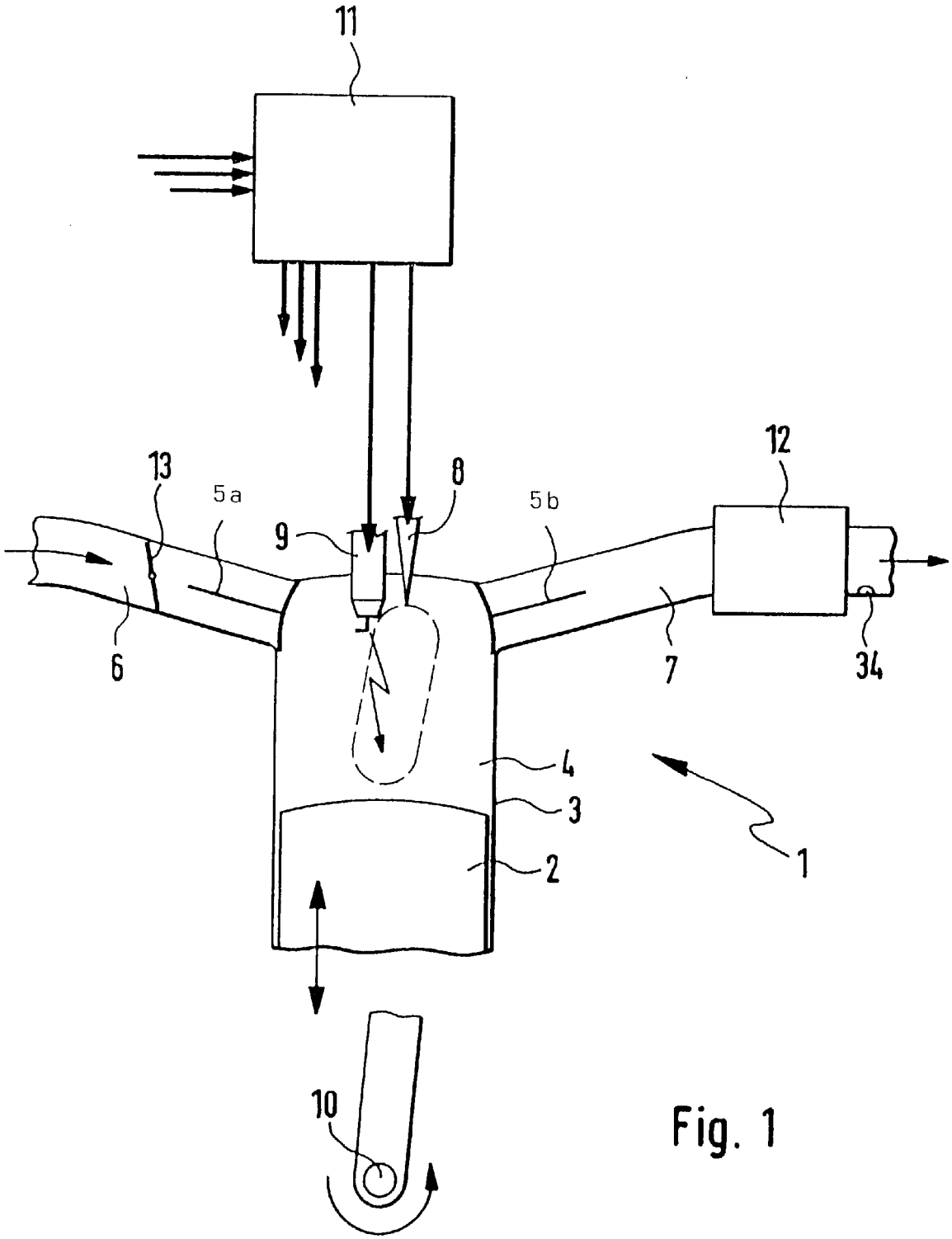
FIG. 1 is a schematic of the internal combustion engine according to an embodiment of the invention.

In FIG. 1, an internal combustion engine 1 is shown wherein a piston 2 is movable upwardly and downwardly in a cylinder 3. The cylinder 3 is provided with a combustion chamber 4 to which an intake manifold 6 as well as an exhaust-gas pipe 7 are connected via respective valves 5*a* and 5*b*. An injection valve 8 and a spark plug 9 are assigned to the engine.

In a first operating mode (in the stratified operation of the engine 1), fuel is injected into the combustion chamber 4 during a compression phase caused by the piston 2 with this injection being spatially in the immediate vicinity of the spark plug 9 as well as being, in time, directly in advance of the top dead center position of the piston 2. The fuel is then ignited with the aid of the spark plug 9 so that the piston 2 is driven in the following operating phase by the expansion of the ignited fuel.

In a second operating mode (the homogeneous operation of the engine 1), the fuel is injected by the injection valve 8 into the combustion chamber 4 during an induction phase caused by the piston 2. The injected fuel is swirled by the simultaneously inducted air and is therefore distributed essentially uniformly in the combustion chamber 4. Thereafter, the air/fuel mixture is compressed during the compression phase in order to then be ignited by the spark plug 9. The piston 2 is driven by the expansion of the ignited fuel.

In stratified operation as in homogeneous operation, rotation is imparted by the driven piston to a crankshaft 10 via which the wheels of the motor vehicle are ultimately driven.

The fuel mass, which is injected in stratified operation and in homogeneous operation by the injection valve 8 into the combustion chamber 4, is controlled (open loop and/or closed loop) by a control apparatus 11 especially in view of obtaining a low fuel consumption and/or a low exhaust-gas generation. For this purpose, the control apparatus 11 is provided with a microprocessor which has a program stored in a storage medium such as in a read-only-memory (ROM). This program is suitable for carrying out the above-mentioned control (open loop and/or closed loop).

The exhaust-gas pipe 7 is connected to a catalytic converter 12 which is provided with an oxidation catalytic converter for oxidizing especially hydrocarbons and carbon monoxides as well as with a storage catalytic converter for storing nitrogen oxides.

An oxygen excess (that is, a lean mixture) or an oxygen deficiency (that is, a rich mixture) or a stoichiometric ratio of the air and fuel results in the combustion chamber 4 of the engine 1 in dependence upon the air/fuel mixture ratio adjusted by the control apparatus 11. The rich mixture is adjusted especially during homogeneous operation of the engine 1; whereas, the lean mixture is present to reduce consumption especially during stratified operation.

For oxygen excess, the oxidation catalytic converter can reduce the nitrogen oxides supplied to the catalytic converter 12 and therefore draw off the oxygen from the nitrogen oxides.

However, the oxidation catalytic converter takes up the oxygen present in excess because of the oxygen excess. The nitrogen oxides, which are not used by the oxidation catalytic converter, are taken up by the storage catalytic converter and stored. This defines a charging operation of the catalytic converter 12 wherein nitrogen oxides flow to the catalytic converter 12.

The storage catalytic converter again releases the stored nitrogen oxides when there is an oxygen deficiency. This defines a discharge operation of the catalytic converter 12 wherein the nitrogen oxides flow out of the catalytic converter 12. Because of the oxygen deficiency, there is not sufficient oxygen present and, for this reason, the oxidation catalytic converter draws the oxygen out of the nitrogen oxides in order to oxidize the hydrocarbons and carbon monoxides developed during combustion.

The catalytic converter 12 cannot store nitrogen oxides to an unlimited extent. For this reason, the charging operation must be limited as a function of time. Thereafter, the catalytic converter 12 must again be discharged. This charging and discharging is controlled (open loop and/or closed loop) by the control apparatus 11 via a corresponding oxygen supply. The oxygen supply is achieved via the corresponding operation of the engine 1 in homogeneous operation or in stratified operation. A throttle flap 13 present in the intake manifold 6 is used especially for influencing the oxygen supply.

In the following, three possibilities are described as to how the charging and discharging of the catalytic converter 12 can be controlled (open loop and/or closed loop) by the control apparatus 11.

Figure 2:
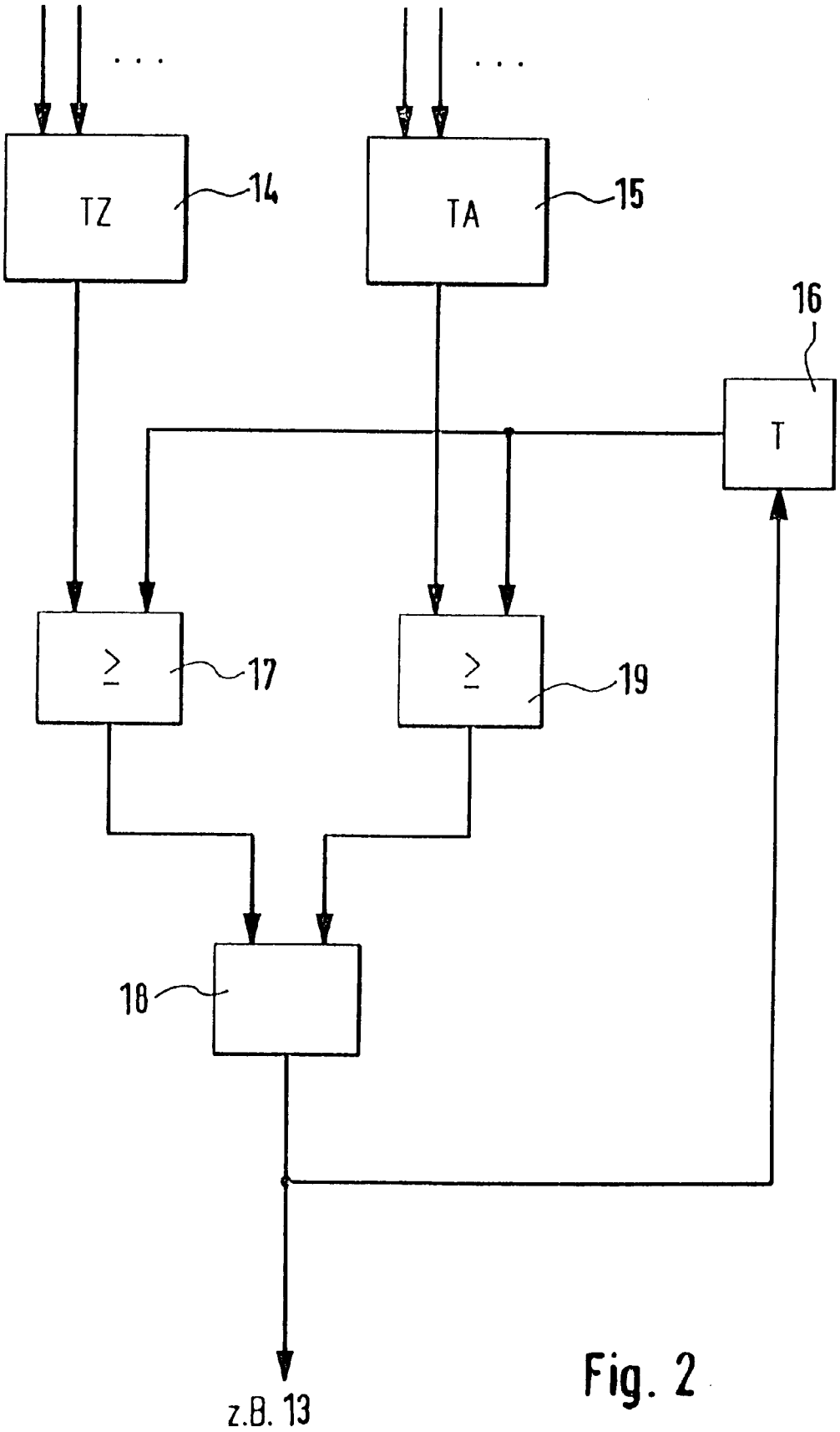
FIG. 2 is a schematic block circuit diagram of a first embodiment of the method of the invention for operating the engine of FIG. 1.

In FIG. 2, an inflow time TZ is determined in block 14 and an outflow time TA is determined in block 15. The inflow time TZ defines that time duration in which the catalytic converter 12 is charged with nitrogen oxides and the outflow time TA defines that time duration in which the catalytic converter 12 is again discharged. The inflow time TZ and the outflow time TA are determined by the control apparatus 11 especially in dependence upon the rpm of the engine 1 and/or on the load applied to the engine 1 and/or on the temperature of the catalytic converter 12 and/or on the temperature of the engine 1.

Furthermore, a clock 16 is provided having an output signal corresponding to a time duration T which becomes ever greater. The clock 16 is reset after each changeover of the oxygen inflow.

For an oxygen excess, the output signal of the clock 16 is compared to the inflow time TZ by a comparator 17. If the output signal of the clock 16 is equal to or greater than the time duration given by the inflow time TZ, then a changeover signal is generated and transmitted to a changeover unit 18. The changeover unit 18 effects, on the one hand, that the oxygen supply to the combustion chamber 4 of the engine 1 is changed over from the oxygen excess to an oxygen deficiency. On the other hand, the changeover unit 18 resets the clock 16 as mentioned.

For an oxygen deficiency, the output signal of the clock 16 is compared to the outflow time TA via a comparator 19. If the output signal of the clock 16 reaches the time duration pregiven by the outflow time TA, then a changeover signal is generated and transmitted to the changeover unit 18. The changeover unit effects, on the one hand, that the oxygen supply to the combustion chamber 4 is changed over from the oxygen deficiency either to an oxygen excess or to a stoichiometric ratio. On the other hand, the clock 16 is again reset.

The changeover of the oxygen supply can, as mentioned, take place via the throttle flap 13, for example.

Figure 3:
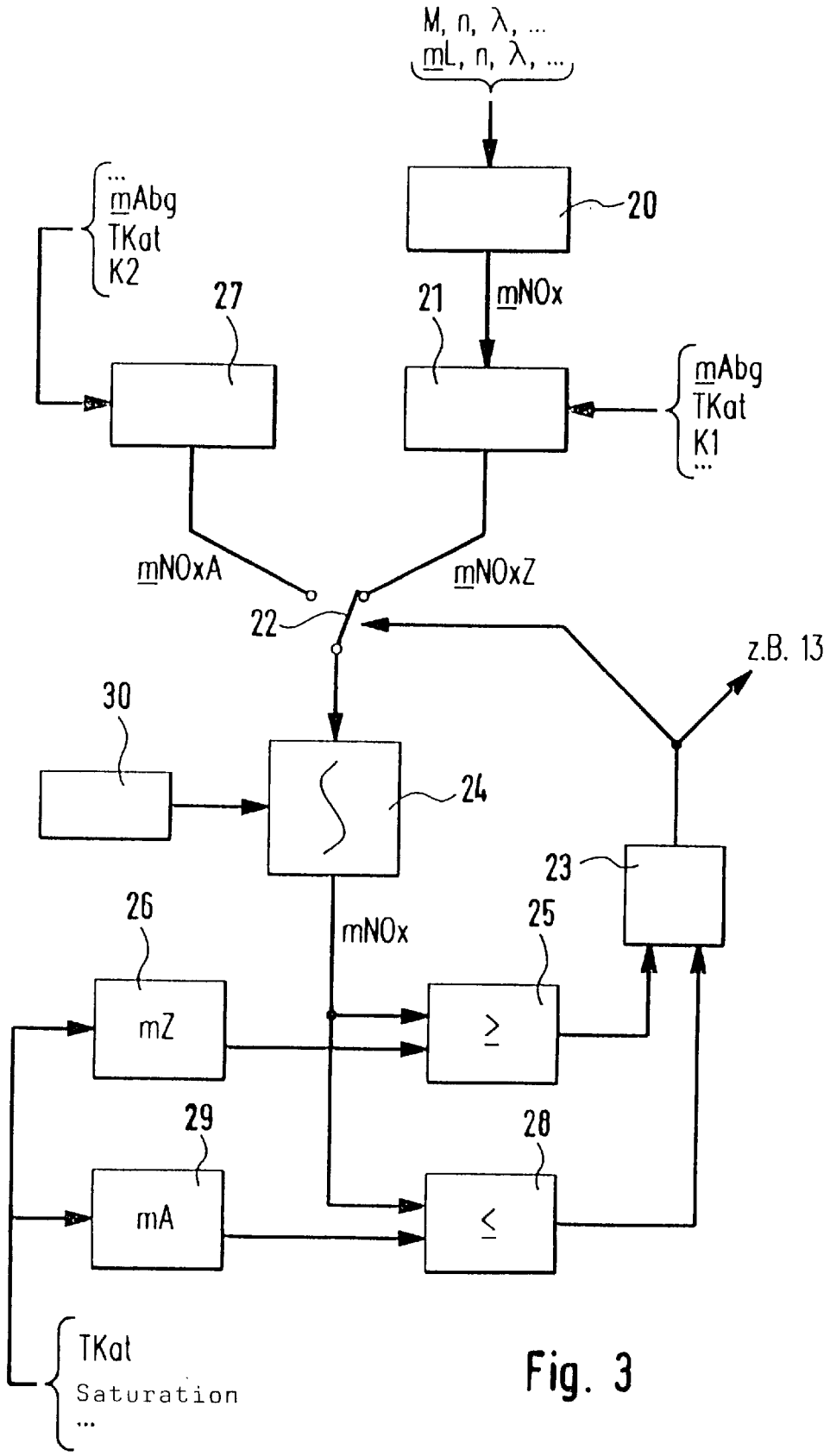
FIG. 3 is a schematic block diagram of a second embodiment of the method of the invention for operating the engine of FIG. 1; and, FIG. 4 is a schematic block circuit diagram of a third embodiment of the method according to the invention for operating the engine shown in FIG. 1.

In FIG. 3, and when there is an oxygen excess, the mass flow mNOx of the nitrogen oxides to the catalytic converter 12 is determined by the control apparatus 11 in a block 20. This can be undertaken in the form of a characteristic field stored in the control apparatus 11. The characteristic field is dependent at least upon the load M applied to the engine 1. Alternatively, it is possible that the characteristic field is dependent upon the air mass flow mL supplied to the combustion chamber 4. Furthermore, the characteristic field is, in both cases, dependent upon the rpm (n) of the engine 1 and/or on the ratio of the air/fuel mixture λ and/or other parameters.

In block 21, the mass flow mNOx is corrected with respect to the actual storage rate of the catalytic converter 12. This is carried out, inter alia, in dependence upon the mass flow mabg of the exhaust gas and/or the temperature TKat of the catalytic converter 12 and/or the temperature of the engine 1. The temperature TKat of the catalytic converter 12 can be determined via a temperature model, for example, from the temperature of the engine 1 or with the aid of an appropriately arranged sensor.

Furthermore, a factor K1 is considered in the block 21.

This factor K1 corresponds to the component of those nitrogen oxides which pass unchanged through the catalytic converter 12 and are outputted to the ambient. The output signal of the block 21 defines the effective mass flow mNOxZ of the nitrogen oxides flowing into the catalytic converter 12.

For an oxygen excess, a switch 22 is driven by a reversal unit 23 in such a manner that the block 21 is connected to a block 24. In block 24, the mass flow mNOxZ is integrated or added so that, in this way, the mass mNOx of the nitrogen oxides which flows into the catalytic converter 12 and is stored therein, is determined by the control apparatus 11. This stored mass mNOx becomes ever larger during the oxygen excess because of the inflowing nitrogen oxides until the catalytic converter 12 can no longer take up nitrogen oxides and store the same. The above-mentioned integration corresponds to the charging of the catalytic converter 12.

The mass mNOx of the nitrogen oxides flowing into the catalytic converter 12 is supplied to a comparator 25 to which the inflow mass mZ is also applied. The inflow mass mZ corresponds to that mass of nitrogen oxides which the catalytic converter 12 can take up as a maximum and store. The inflow mass mZ is generated by a block 26. The inflow mass mZ is, inter alia, dependent upon the temperature TKat of the catalytic converter 12 and/or the saturation characteristic of the storage catalytic converter.

As soon as the mass mNOx is equal to or greater than the inflow mass mZ, a changeover signal is generated and transmitted to the changeover unit 23. This changeover signal signifies that the catalytic converter 12 is almost fully charged. Because of this changeover signal, the changeover unit 23 effects, on the one hand, that the oxygen supply to the combustion chamber 4 of the engine 1 is changed over from the oxygen excess to an oxygen deficiency. This, as mentioned, is achieved, for example, by means of the throttle flap 13. On the other hand, the switch 22 is controlled to its other switch position by the changeover unit 23 so that now a block 27 is connected to the block 24. The integrator of the block 24 is not reset.

For an oxygen deficiency, a mass flow mNOxA which is generated by the block 27, is integrated with a negative sign by the block 24. The maximum mass mNOx, which arises because of the charging, corresponds to the inflow mass mZ. The mass flow mNOxA is continuously subtracted from this mass mNOx. This defines the discharge of the catalytic converter 12. The mass flow mNOxA is then determined in dependence upon the following: the mass flow mAbg of the exhaust gas and/or the temperature TKat of the catalytic converter 12 and/or the temperature of the engine 1. Furthermore, a factor K2 is considered by the block 27. This factor K2 corresponds to the component of the particular carbon monoxides which pass unchanged through the catalytic converter 12 and are outputted to the ambient.

The mass mNOx of the nitrogen oxides, which is generated by the block 24 in this manner and is still present in the catalytic converter 12, is supplied to a comparator 28 to which an outflow mass mA is also applied. The outflow mass mA corresponds to that mass at which the catalytic converter 12 is almost free of nitrogen oxides. The outflow mass mA is generated by a block 29. The outflow mass mA is, inter alia, dependent upon the following: the temperature TKat of the catalytic converter 12 and/or the saturation characteristic of the storage catalytic converter. If required, the outflow mass mA can also be 0.

As soon as the mass mNOx becomes equal to or less than the outflow mass mA, a changeover signal is generated and is transmitted to the changeover unit 23. This changeover signal has the significance that the catalytic converter 12 is almost completely discharged. Because of the changeover signal, the changeover unit 23 effects, on the one hand, that the oxygen supply to the combustion chamber 4 of the engine 1 is changed over from the oxygen deficiency to an oxygen excess. This is achieved, as mentioned, by means of a throttle flap 13, for example. On the other hand, when the switch 22 is again controlled into its other switching position by the changeover unit 23 so that the block 21 is again connected to the block 24. The integrator of the block 24 is not reset again.

In this way, the mass mNOx, which is generated by the integrator of block 24, always defines that mass of nitrogen oxides which are stored in the catalytic converter. The control (open loop and/or closed loop) of the oxygen supplied to the combustion chamber 4 of the engine 1 is undertaken in dependence upon the mass mNOx. The oxygen supply and therefore the charging and discharging of the catalytic converter 12 is always dependent upon the charging state of the catalytic converter 12. The catalytic converter 12 is alternately charged by means of the control apparatus 11 with nitrogen oxides and thereafter again discharged.

When the engine 1 is switched off and thereafter started again, the integrator of block 24 is set to a start value by means of a block 30. This start value is especially dependent upon the charging state of the catalytic converter 12 during the previous termination of the operation of the engine 1.

Furthermore, the start value can be dependent upon the particular temperature TKat of the catalytic converter 12 at the termination and at the next resumption of the operation of the engine 1.

Figure 4:
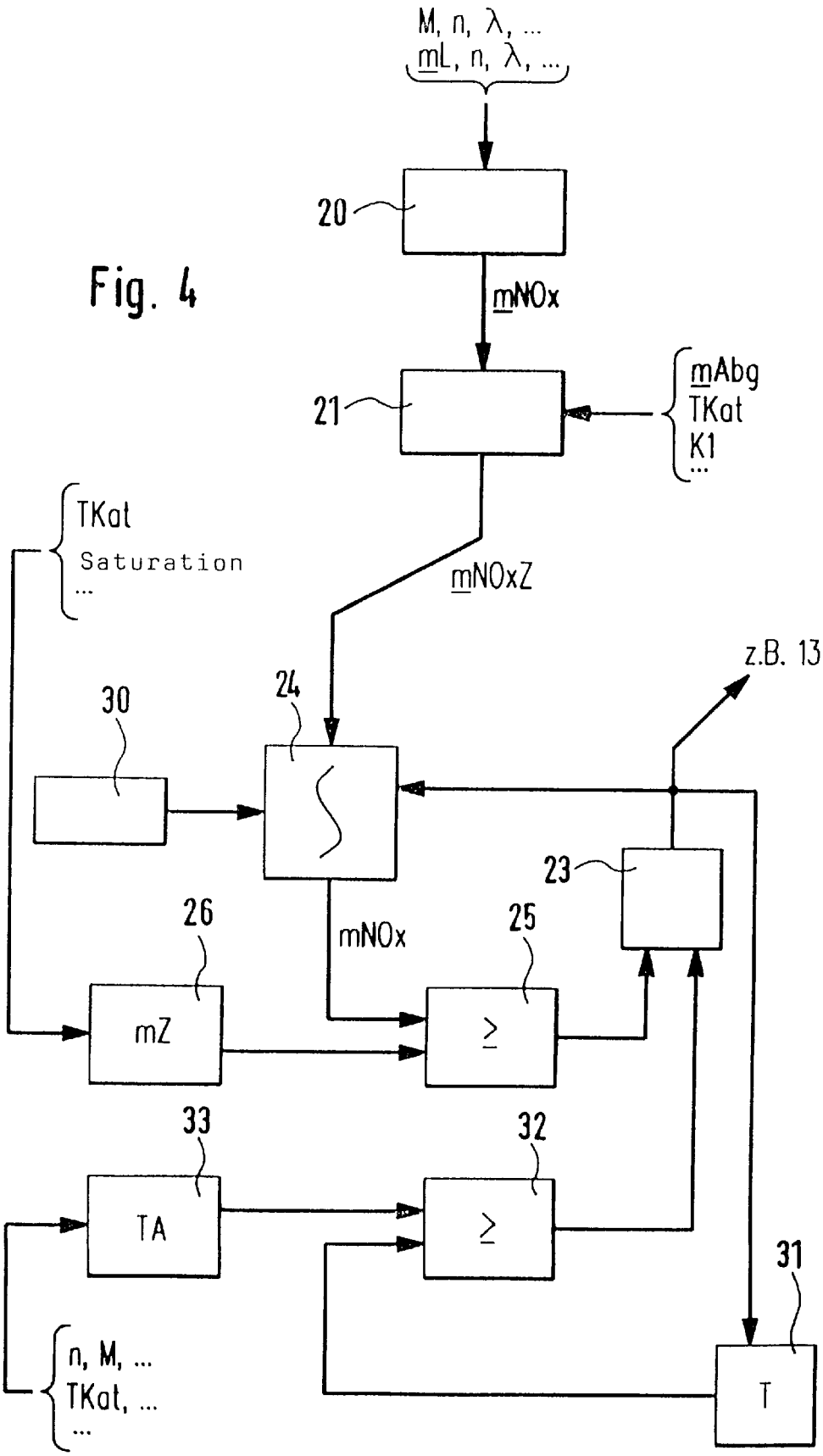

FIG. 4 corresponds substantially to FIG. 3. For this reason, only those features and steps of FIG. 4 are explained in greater detail which distinguish from FIG. 3. The same features and steps are identified in the same way in FIGS. 3 and 4.

FIG. 4 distinguishes from FIG. 3 essentially by a time-dependent discharge in lieu of a mass-dependent discharge of the catalytic converter 12. The switch 22 as well as the blocks 27, 28 and 29 are not present in FIG. 4.

In FIG. 4, the catalytic converter 12 is charged as in FIG. 3 when there is an excess of oxygen. When the mass mNOx of the nitrogen oxides, which flow to the catalytic converter 12, reach the inflow mass mZ, then the oxygen inflow is changed over by means of changeover unit 23 in the direction of oxygen deficiency. In FIG. 4, this changeover unit 23 effects that a clock 31 is reset. The output signal of the clock 31 defines a time duration T which becomes ever larger and which is compared to a pregiven time duration TA by means of a comparator 32. If the output signal of the clock 31 is equal to or greater than the pregiven time duration TA, then the oxygen deficiency is ended and a switchover from the oxygen deficiency to the oxygen excess takes place via the reversal unit 23. For this changeover, the integrator of the block 24 is again reset or set to the start value pregiven by block 30.

The time duration TA is pregiven by block 33. The time duration TA is determined in dependence upon the following: the rpm (n) of the engine 1 and/or the load M applied to the engine 1 and/or the temperature TKat of the catalytic converter 12 and/or the temperature of the engine 1.

As a supplement to the engine 1 shown in FIG. 1, it is possible to provide a lambda sensor 34 downstream of the catalytic converter 12. In this way, the ratio of the air/fuel mixture downstream of the catalytic converter 12 can be monitored by the lambda sensor 34. As soon as the lambda sensor 34 detects a transition from a lean air/fuel mixture to a rich air/fuel mixture, this means that the catalytic converter 12 no longer releases sufficient oxygen for oxidizing the hydrocarbons and the carbon monoxides. The storage catalytic converter is therefore discharged. This transition can be used to end the oxygen deficiency and therefore the discharge operation and to change over the oxygen supply again to a charging operation. Accordingly, the termination of the oxygen deficiency is influenced in dependence upon the lambda sensor 34.

It is here possible, with the aid of the lambda sensor 34, to influence the output signals of the blocks (14, 15) of FIG. 2 or the blocks (26, 29) of FIG. 3 or the blocks (26, 33) of FIG. 4 or to operate on the start value of block 30 in FIGS. 3 and 4. It is especially possible to achieve, by means of the lambda sensor 34, an adaptation or compensation of the methods described in FIGS. 2, 3 and 4 with respect to possible inaccuracies in the determination of the pregiven masses or times or with respect to possible changes of the above-mentioned masses or times which are caused by deterioration.

It is understood that the foregoing description is that of the preferred embodiments of the invention and that various changes and modifications may be made thereto without departing from the spirit and scope of the invention as defined in the appended claims.

What is claimed is:

1. A method for operating an internal combustion engine for a motor vehicle, the internal combustion engine defining a combustion chamber wherein an air/fuel mixture is combusted during operation of said engine whereby an exhaust gas containing nitrogen oxides is generated, the method comprising the steps of:

treating said exhaust gas with a catalytic converter suitable for reducing said nitrogen oxides supplied thereto;

supplying said air/fuel mixture to said combustion chamber in such a manner that an oxygen excess is first present in said combustion chamber and then an oxygen deficiency is present therein;

determining the mass (mNOx) of said nitrogen oxides flowing into said catalytic converter during said oxygen excess by integrating the mass flow (mNOxZ) of said nitrogen oxides flowing to said catalytic converter;

changing over from said oxygen excess to said oxygen deficiency when a pregiven inflow mass (mZ) is reached;

determining the mass (mNOx) of the nitrogen oxides still present in said catalytic converter during said oxygen deficiency;

ending said oxygen deficiency when a pregiven outflow mass (mA) is reached; and, determining the mass (mNOx) of the nitrogen oxides flowing out of said catalytic converter by integrating the mass flow (mNOxA) of the nitrogen oxides flowing away from said catalytic converter.

2. The method of claim 1, comprising the further step of determining the mass flow (mNOxZ) of the nitrogen oxides flowing to said catalytic converter from one of the air mass flow (mL) to said combustion chamber and the load (M) applied to said internal combustion engine.

3. The method of claim 2, comprising the further step of considering at least one of the following: the rpm (n) of said internal combustion engine and the ratio (λ) of said air/fuel mixture in said combustion chamber when determining said mass (mNOx) of said nitrogen oxides.

4. The method of claim 1, comprising the further step of considering at least one of the following when determining said mass (mNOx): said mass flow (mAbg) of said exhaust gas; the temperature (TKat) of said catalytic converter; and, the temperature of said internal combustion engine.

5. The method of claim 1, comprising the further step of determining at least the following: said pregiven inflow mass (mZ); and, the pregiven outflow mass (mA) both in dependence upon the following: the temperature (TKat) of said catalytic converter; and, the saturation property of said catalytic converter.

6. The method of claim 1, comprising the further step of monitoring the ratio of said air/fuel mixture downstream of said catalytic converter; and, influencing the termination of said oxygen deficiency in dependence upon said ratio.

7. A control element such as a read-only-memory for a control apparatus of an internal combustion engine such as for a motor vehicle; said control element comprising:

a program stored in said control element which is run on a computer apparatus; and, said program functioning to perform the method steps of:

treating said exhaust gas with a catalytic converter suitable for reducing said nitrogen oxides supplied thereto;

supplying said air/fuel mixture to said combustion chamber in such a manner that an oxygen excess is first present in said combustion chamber and then an oxygen deficiency is present therein;

determining the mass (mNOx) of said nitrogen oxides flowing into said catalytic converter during said oxygen excess by integrating the mass flow (mNOxZ) of said nitrogen oxides flowing to said catalytic converter;

changing over from said oxygen excess to said oxygen deficiency when a pregiven inflow mass (mZ) is reached;

determining the mass (mNOx) of the nitrogen oxides still present in said catalytic converter during said oxygen deficiency;

ending said oxygen deficiency when a pregiven outflow mass (mA) is reached; and, determining the mass (mNOx) of the nitrogen oxides flowing out of said catalytic converter by integrating the mass flow (mNOxA) of the nitrogen oxides flowing away from said catalytic converter.

8. The control element of claim 7, said computer apparatus being a microprocessor.

9. An internal combustion engine such as an engine for a motor vehicle, the internal combustion engine defining a combustion chamber wherein an air/fuel mixture is combusted during operation of the engine whereby an exhaust gas containing nitrogen oxides is generated, the internal combustion engine comprising:

a catalytic converter for treating said exhaust gases including reducing said nitrogen oxides when supplied thereto;

means for adjusting said air/fuel mixture supplied to said combustion chamber in such a manner that first an oxygen excess is present in said combustion chamber and then an oxygen deficiency is present therein; and, a control apparatus for determining the mass (mNOx) of said nitrogen oxides flowing to said catalytic converter during said oxygen excess by integrating the mass flow (mNOxZ) of said nitrogen oxides flowing to said catalytic converter and for changing over from said oxygen excess to said oxygen deficiency when said mass (mNOx) reaches a pregiven inflow mass (mZ); and, said control apparatus further functioning to determine the mass (mNOx) of the nitrogen oxides still present in said catalytic converter during said oxygen deficiency and to end said oxygen deficiency when a pregiven outflow mass (mA) is reached; and, to determine the mass (mNOx) of the nitrogen oxides flowing out of said catalytic converter by integrating the mass flow (mNOxA) of the nitrogen oxides flowing away from said catalytic converter.

10. The internal combustion engine of claim 1, said control apparatus functioning to determine the mass (mNOx) of the nitrogen oxides still present in said catalytic converter during said oxygen deficiency; and, said control apparatus functioning to end said oxygen deficiency when a pregiven outflow mass (mA) is reached.

11. The internal combustion engine of claim 9, said control apparatus functioning to end said oxygen deficiency after a pregiven time duration (TA).

* * * * *